US012782069B1

(12) United States Patent
Herring

(10) Patent No.: US 12,782,069 B1
(45) Date of Patent: Nov. 3, 2026

(54) QUICK-RELEASE FIREARM GAS BLOCK

(71) Applicant: Ares Defense Systems, Inc., Melbourne, FL (US)

(72) Inventor: Geoffrey A. Herring, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 0 days.

(21) Appl. No.: 19/449,756

(22) Filed: Jan. 15, 2026

(51) Int. Cl.
*F41A 5/26* (2006.01)

(52) U.S. Cl.
CPC ..... *F41A 5/26* (2013.01)

(58) Field of Classification Search
CPC ..... F41A 5/26; F41A 5/28
See application file for complete search history.

(56) References Cited

U.S. PATENT DOCUMENTS

| | | | | |
|---|---|---|---|---|
| 2,287,032 | A | 6/1942 | Garand | |
| 2,715,858 | A * | 8/1955 | Hoppert | F41A 5/28 89/193 |
| 3,846,928 | A | 11/1974 | Ruger et al. | |
| 3,857,323 | A | 12/1974 | Ruger et al. | |
| 5,824,943 | A * | 10/1998 | Guhring | F41A 5/26 89/192 |
| 8,443,711 | B2 * | 5/2013 | Clark | F41A 5/18 89/193 |
| 10,684,085 | B2 * | 6/2020 | Leitner-Wise | F41A 11/00 |
| 10,718,579 | B2 * | 7/2020 | Barrett | F41A 19/10 |
| 11,060,807 | B2 * | 7/2021 | Lynch | F41A 5/28 |
| 11,287,200 | B1 * | 3/2022 | Oglesby | F41A 21/325 |
| 11,614,299 | B1 * | 3/2023 | Oglesby | F41A 5/26 89/193 |
| 11,927,417 | B2 * | 3/2024 | Kroyer | F41A 5/20 |
| 12,163,754 | B2 * | 12/2024 | Schrödl | F41A 5/26 |
| 12,504,246 | B2 * | 12/2025 | Sims | F41A 5/28 |
| 2010/0024636 | A1 * | 2/2010 | Winge | F41A 5/26 89/193 |
| 2012/0216439 | A1 * | 8/2012 | Barrett | F41A 3/26 42/75.02 |
| 2019/0078851 | A1 * | 3/2019 | Aldophsen | F41A 5/18 |
| 2019/0170461 | A1 * | 6/2019 | Leitner-Wise | F41A 11/00 |
| 2020/0025498 | A1 * | 1/2020 | Wheeler | F41A 21/325 |
| 2020/0033084 | A1 * | 1/2020 | Robinson | F41A 5/28 |
| 2020/0278165 | A1 | 9/2020 | Wheeler et al. | |

(Continued)

*Primary Examiner* — Derrick R Morgan
(74) *Attorney, Agent, or Firm* — David O. Simmons; IVC Patent Agency

(57) ABSTRACT

A firearm gas block assembly includes separate gas block and gas block retaining bodies each having a central bore engageable with a gas block journal of a barrel. The gas block retaining body includes a retention member passage that intersects the central bore of the gas block retaining body to define an opening between the central bore and the retention member passage. A retention member within the retention member passage is moveable between first and second positions. A portion of the retention member extends through the opening when in the first position. No portion of the retention member extends through the opening when in the second position. Gas flow control discontinuities may be within a surface of the gas block defining the central passage. A travel limiting member may be engaged with the retention member and the gas block for limiting axial movement of the retention member.

30 Claims, 10 Drawing Sheets

(56) References Cited

U.S. PATENT DOCUMENTS

| | | | | |
|---|---|---|---|---|
| 2021/0207904 | A1* | 7/2021 | Kroyer | F41A 5/20 |
| 2022/0113099 | A1* | 4/2022 | Geissele | F41A 5/20 |
| 2022/0307783 | A1* | 9/2022 | Puha | F41A 5/26 |
| 2023/0125921 | A1* | 4/2023 | Keeney | F41A 5/28 89/193 |
| 2024/0068759 | A1* | 2/2024 | Puha | F41A 5/28 |
| 2024/0151493 | A1* | 5/2024 | DiChario | F41C 23/16 |
| 2024/0230260 | A1* | 7/2024 | Sims | F41A 5/28 |
| 2024/0240888 | A1* | 7/2024 | Beitelspacher | F41A 5/24 |
| 2024/0247893 | A1* | 7/2024 | Williams | F41A 3/66 |
| 2025/0334362 | A1* | 10/2025 | Beitelspacher | F41A 5/26 |

* cited by examiner

QUICK-RELEASE FIREARM GAS BLOCK

FIELD OF THE DISCLOSURE

The disclosures herein relate generally to firearms, and more particularly to gas block mounting arrangements that enable gas block installation and removal without specialized tools or other type of dedicated devices.

BACKGROUND

Rifles operable in semi-automatic mode of firing only or select-fire mode of firing are well known. For example, the AR15 family of firearms, including the M16 and M4 type firearms, illustrate examples of rifles and carbines (i.e., short-barrel rifles) operable in semi-automatic only mode of firing or select-fire mode of firing. AR15 type rifles available for civilian markets are operable only in the semi-automatic mode of firing, whereas M16 and M4 type firearms are a military version of the AR15 family of firearms operable in select-fire modes of firing—e.g., two or more of semi-automatic mode where a round of ammunition is discharged for each pull of the trigger, fully automatic mode where rounds of ammunition are continuously discharged for each pull of the trigger until the trigger is released of until an ammunition supply of the rifle (e.g., ammunition magazine or ammunition belt) is depleted, and burst mode where a finite number of rounds less than an on-board ammunition supply (e.g., 2-3 rounds) are discharged for each pull of the trigger.

It is also well-known and common for rifles operable is semi-automatic only mode and select-fire modes to have a gas block mounted on the barrel. The gas block enables combustion gas from discharge of each round of ammunition to provide energy for ejecting a spent round of ammunition from the barrel chamber and autoloading a new round of ammunition from the ammunition supply into the barrel chamber—i.e., a "gas-operated" firearm. As an example of gas block operation, M16-type and M4-type rifles include a gas block mounted on the barrel and a bolt carrier group slidable engaged within a central bore of an upper receiver of the rifle. The barrel has a gas port extending from a bore of the barrel to an exterior surface of the barrel at a gas block journal at which the gas block is mounted on the barrel. A gas routing passage of the gas block has its inlet aligned with the gas port to enable combustion gas to be routed from the bore of the barrel into the gas block. The bolt carrier group includes a bolt carrier having a portion that acts as a gas cylinder and a bolt having an end portion (i.e., a piston) that is engaged within the gas cylinder portion of the bolt carrier. A gas tube, which is connected to the gas block on one end and slidably engaged at its other end is a gas key attached to the bolt carrier, includes a gas tube passage extending along its length for communicating the combustion gas therethrough.

Operationally, the gas tube enables communication of combustion gas and associated pressure resulting from expansion of the combustion gas from the barrel bore to the bolt carrier group via a passage jointly defined by the gas port, the gas routing passage, and the gas tube passage. Upon discharge of a round of ammunition, a projectile of the round passes the gas port as it travels down the bore of the barrel whereby some of the combustion gas that is propelling the projectile escapes from the bore of the barrel into the gas block (i.e., carrier group energizing combustion gas). This carrier group energizing combustion gas and resulting pressure are in turn transmitted into a gas cylinder portion of the bolt carrier via the gas key. Upon entering the gas cylinder, the pressure generated by expansion of the carrier group energizing combustion gas forces a separation of the bolt and bolt carrier, thereby acting to propel them in opposite directions. Because the bolt is fixedly locked with lugs of the barrel during and immediately after a round of ammunition in the barrel chamber is discharged, the bolt carrier travels in a direction away from the barrel (i.e., the recoil direction), thereby causing the bolt to become unlocked from the barrel for allowing continued rearward travel of the bolt carrier and other components of the bolt carrier group. During an initial phase of movement of the bolt carrier in the recoil direction, a portion of the bolt carrier group energizing combustion gas may be vented through ports in the bolt carrier to the outside of the upper receiver, the spent round of ammunition (i.e., its casing) is stripped from within the barrel chamber after which it is ejected from the rifle.

At a point where rearward travel of the bolt carrier causes the gas key to disengage from the gas tube, a remaining portion of the carrier group energizing combustion gas may be vented into the upper receiver. Upon the bolt carrier group reaching its fully recoiled position by virtue of its rearward movement being fully arrested by a buffer and compressed action spring, the action spring returns the bolt carrier group in the counter-recoil direction until the bolt engages and becomes locked with the barrel. During this travel of the bolt carrier group in the counter-recoil direction, a new round of ammunition is loaded from the ammunition supply into the barrel chamber, if available from within the ammunition supply. A specific example of autoloading functionality for a gas-operated rifle may be found in U.S. Pat. No. 2,951,424 of Eugene Stoner.

A skilled person will understand that the gas block is a crucial component of a gas-operated rifle. Not only does it enable routing of combustion gas from the barrel to the bolt carrier group via the gas tube, but the gas block also secures the gas tube in position relative to the upper receiver. In conventional arrangements, the gas block and combined "A-Frame" front sight component from an AR15 or M16 type firearm is secured to the barrel with one or more taper pins, creating a semi-permanent installation of the gas block to the barrel journal and consequently, a limitation to the handguard length which resides behind it. In the case of the legacy fixed A-Frame type of gas block, the relationship between the gas block and the gas block mounting barrel journal are tightly controlled to within 0.0005"-0.001" to prevent gas leakage and resultant potential "short stroke" malfunctions. In more recent years, some manufacturers have configured their AR15 or M16 type firearm barrels with a "low profile gas block" which is generally devoid of the conventional "A-Frame" sight arrangement, permitting the gas block to be disposed within the rifle's accessory handguard, which in turn can be longer to provide for more accessory mounting real estate or alternative hand gripping options for controlling the firearm. In the case of a low-profile gas block, the gas block is secured to the barrel via one or more threaded fasteners, which require a specialized device (e.g., a wrench) to loosen and tighten the one or more threaded fasteners. Servicing of the rifle can be precluded or delayed when this specialized device is not available. Even when it is available, manipulation of the one or more fasteners with this specialized device can be time-consuming and result in one or more fasteners becoming lost or damaged. The threaded fasteners can also become loose during firing, resulting in movement of the gas block and consequential malfunctions of the firearm to which it is attached. Another deficiency with low profile gas blocks that use screws for tightening to the barrel, is due to the associated manufacturing tolerances that various manufacturers elect to utilize. When manufacturers utilize low profile gas blocks with threaded fasteners, the manufacturing tolerances between the gas block and barrel journal are often much looser, which in turn is more cost effective for the manufacturer. In the case of the low profile gas block, the set screws that retain the block are generally disposed on the opposite side of the barrel from the gas port. Accordingly, when the set screws are tightened against the barrel journal, the gas block manifold that overlaps the barrel's gas port is sealed tightly against the barrel preventing gas leakage. Due to the limitations and potential failure points of set screw secured gas blocks, none of these situations are desirable, particularly during a combat or law enforcement situation.

Accordingly, gas block interface configurations that reduce or eliminate gas leakage between the gas block and interfacing components such as the gas block journal or gas tube, and gas block retention arrangements that eliminate the use of threaded fasteners for securing the gas block in position on the barrel and, thus, eliminate the need for a specialized device for manipulation of such treaded fasteners would be advantageous, desirable and useful.

SUMMARY OF THE DISCLOSURE

Embodiments of the disclosures made herein are directed to gas block retention arrangements that eliminate the use of threaded fasteners for securing the gas block in position on the barrel and, thus, eliminate the need for a specialized device for manipulation of such treaded fasteners—i.e., a quick-release gas block. Gas block retention arrangements in accordance with embodiments of the disclosures made herein, enable attachment and detachment of a gas block using nothing more than a readily available implement such as an article having a pointed tip (e.g., a round of ammunition, a belt buckle prong, or the like) or an article having a thin or sharp edge (e.g., a knife blade or the like). Being able to remove and install a gas block from a barrel of a rifle without the use of a specialized device provides for simplified serviceability of the rifle, which is desirable and beneficial regardless of whether the rifle is used in the civilian, law enforcement, or military applications.

In one or more embodiments, a firearm gas block system comprises a gas block and a gas block retaining assembly. The gas block has a central bore extending through opposing end faces of the gas block. A first one of the opposing end faces of the gas block is a main body engagement face. The central bore has a diametrical size for operably mating with a gas block journal of a barrel. A gas block retaining assembly including main body having a central bore extending through opposing end faces of the main body, a retention member passage intersecting the central bore of the main body to define an opening between the central bore of the main body and the retention member passage, and a retention member within the retention member passage. The retention member is moveable between a first position within which at least a portion of the retention member extends through the opening into the central bore of the main body and a second position within which no portion of the retention member extends through the opening into the central bore of the main body. A second one of the opposing end faces of the main body is a gas block engagement face. The central bore has a diametrical size for operably mating with the gas block journal of the barrel.

In one or more embodiments, a firearm gas block system comprises a gas block and a gas block retaining assembly. The gas block is engageable with a gas block journal of a barrel. The gas block includes barrel engagement surfaces for engaging mating engagement surfaces of the barrel to locate the gas block in a prescribed axial position and a prescribed rotational position relative to an outlet of a gas port exposed a surface of the gas block journal. The gas block includes a gas passage for routing combustion gas from the gas port to a gas tube receiving cavity of the gas block when the gas block is engaged with the gas block journal in the prescribed axial position and the prescribed rotational position. The gas block retaining assembly includes a main body engageable with the gas block journal in a rotational position independent of the prescribed rotational position of the gas block. The gas block retaining assembly includes a retention member engaged with the main body and engageable with a mating portion of the barrel for securing the main body in a prescribed axial position and a prescribed rotational position relative to the gas port.

In one or more embodiments, a firearm comprises a barrel, a gas block, and a gas block retaining assembly. The barrel includes a gas block journal at an exterior surface thereof, a retention member recess extending through the gas block journal, a bore extending longitudinally along a length of the barrel, and a gas port having an outlet thereof exposed at the gas block journal and a second end expose within the bore. The gas block is engageable with the gas block journal. The gas block includes barrel engagement surfaces engaged with mating engagement surfaces of the barrel for locating the gas block in a prescribed axial position and a prescribed rotational position relative to the outlet of the gas port. The gas block includes a gas passage for routing combustion gas from the gas port to a gas tube receiving cavity of the gas block when the gas block is engaged with the gas block journal in the prescribed axial position and the prescribed rotational position. The gas block retaining assembly includes a main body engageable with the gas block journal in a rotational position independent of the prescribed rotational position of the gas block. The gas block retaining assembly includes a retention member engaged with the main body and engageable with a mating portion of the barrel for securing the main body in a prescribed axial position and a prescribed rotational position relative to the gas port.

In one or more embodiments, the main body includes a retention member mounting body and the retention member passage is within the retention member mounting body.

In one or more embodiments, the gas block includes a rotational alignment member and the rotational alignment member is a unitarily-formed part of the gas block.

In one or more embodiments, the rotational alignment member extends beyond a second one of the opposing end faces of the gas block.

In one or more embodiments, the gas block and the main body are coupled to each other to inhibit axial separation therebetween while permitting rotational movement therebetween.

In one or more embodiments, the gas block includes a gas tube mounting body, the main body includes a retention member mounting body, and the retention member passage is within the retention member mounting body.

In one or more embodiments, the gas block and the main body are discrete bodies.

In one or more embodiments, the main body engagement face and the gas block engagement face are jointly configured to provide substantially and/or operably flush engagement when the respective central bore thereof is operably mated with the gas block journal of the barrel.

In one or more embodiments, the gas block includes a plurality of gas flow control discontinuities, the plurality of gas flow control discontinuities includes two spaced-apart groves each within the gas block extending circumferentially around the central bore of the gas block, the gas block includes a gas tube mounting body having a gas tube receiving cavity and a gas routing passage having a first end exposed within the central bore of the gas block and a second end exposed within the gas tube receiving cavity, and the first end of the gas routing passage is exposed within the central bore of the gas block between the two spaced-apart groves.

In one or more embodiments, the gas block retaining assembly includes a travel limiting member, the travel limiting member is in spring-biased engagement with the retention member, and a tip portion of the travel limiting member is engageable with one or more mating features of the retention member for limiting movement of the retention member to be between the first and second positions.

In one or more embodiments, the one or more mating features of the retention member includes a groove.

In one or more embodiments, the one or more mating features of the retention member includes spaced-apart position control recesses that each define a respective one of the first position of the retention member and the second position of the retention member and the tip portion of the travel limiting member engages a first one of the position control recesses when the retention member is in the first position and engages a second one of the position control recesses when the retention member is in the second position.

In one or more embodiments, the one or more mating features of the retention member includes a groove having opposing ends and the first one of the position control recesses is located at or adjacent a first one of the opposing ends of the groove and the second one of the position control recesses is located at or adjacent a second one of the opposing ends of the groove.

These and other objects, embodiments, advantages and/or distinctions of the present invention will become readily apparent upon further review of the following specification, associated drawings and appended claims.

DETAILED DESCRIPTION

Figure 1:
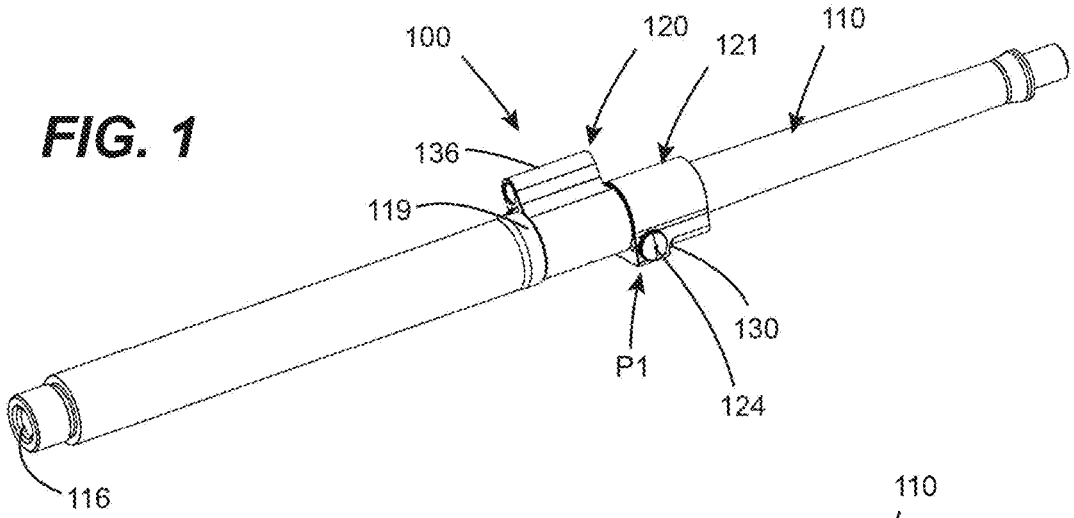
FIG. 1 is a first perspective view of a firearm barrel system in accordance with a first embodiment of the disclosures made herein.
Figure 2:
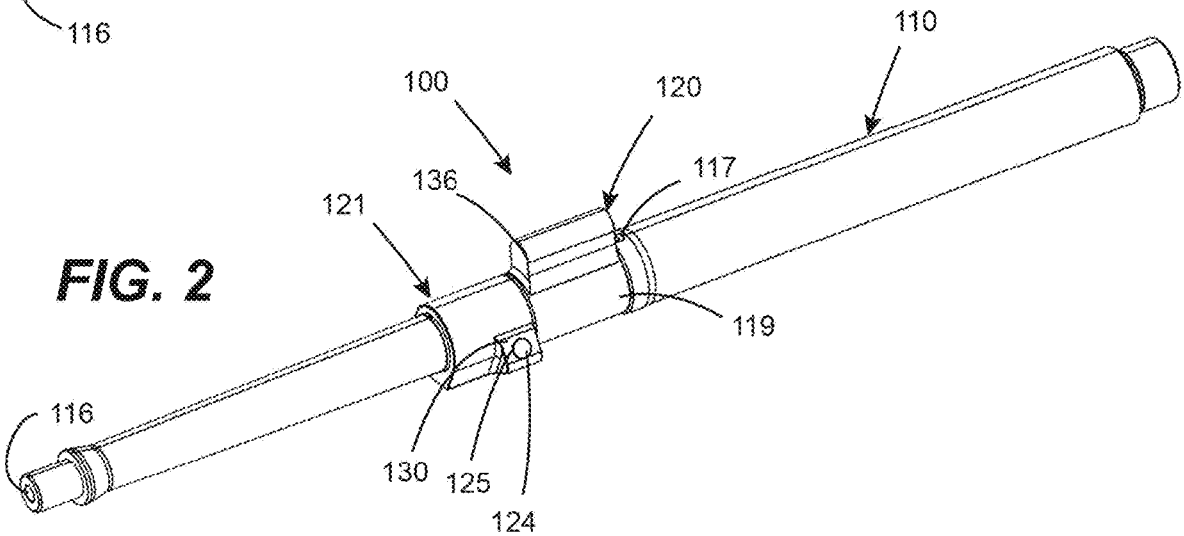
FIG. 2 is a second perspective view of the firearm barrel system shown in FIG. 1.
Figure 3:
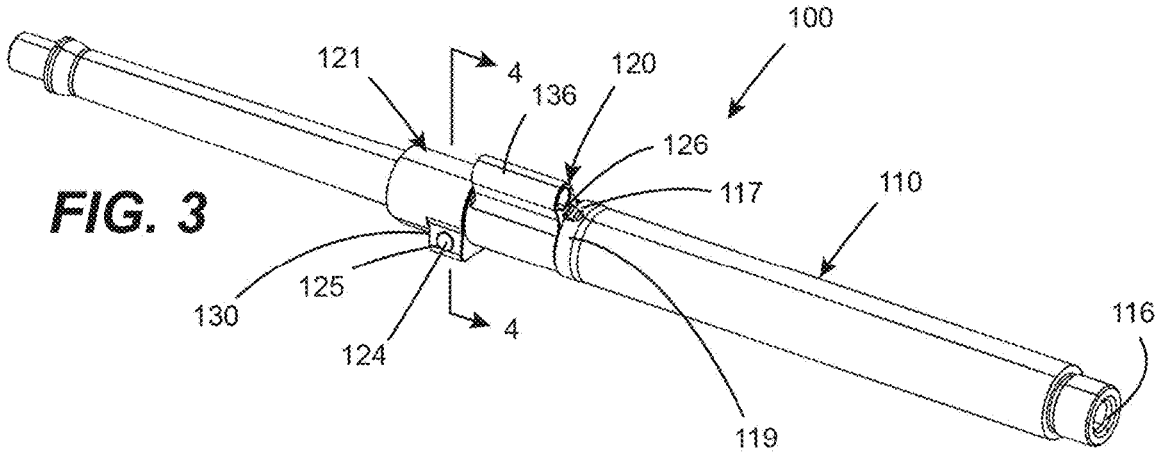
FIG. 3 is a third perspective view of the firearm barrel system shown in FIG. 1.

Referring to FIGS. 1-16, aspects of a firearm barrel system 100 in accordance with embodiments of the disclosures made herein is discussed. The firearm barrel system 100 comprises a barrel 110, a gas block 120, and a gas block retaining assembly 121. Advantageously, the barrel 110, the gas block 120, and the gas block retaining assembly 121 are jointly configured for enabling detachment and attachment of the gas block 120 and gas block retaining assembly 121 (i.e., jointly a gas block system) from the barrel 110 without the need for a specialized device, instead using a readily available implement such as an article having a pointed tip (e.g., a round of ammunition, a belt buckle prong, or the like) or an article having a thin or sharp edge (e.g., a knife blade or the like). This is in contrast to many conventional firearm barrel systems that require a specialized device (i.e., tool) for loosening threaded fasteners used for securing a gas block assembly thereof to a barrel thereof.

Beneficially, firearm barrel systems in accordance with embodiments of the disclosures made herein (e.g., the firearm barrel system 100) decouple the gas routing functionality of the gas block (e.g., gas routing within the gas block 120) from the gas block retaining functionality at least from the standpoint of respective rotational positions when mounted. To this end, the gas block 120 and a main body 122 of the gas block retaining assembly 121 are preferably discrete (e.g., separate) bodies. Such decoupling advantageously permits features/elements of the gas block 120 and the gas block retaining assembly 121 to each possess relatively tight dimensions and/or dimensional tolerances as related to associated features/elements of the barrel 110—e.g., those related to axial and rotational positioning of features/elements of the gas block 120 and features/elements of the gas block retaining assembly 121 relative to the respective associated features/elements of the barrel 110. In contrast, prior art implementations of gas block assemblies with a single unitary body for providing both gas routing functionality and gas block retaining functionality must accommodate such dimensions and/or dimensional tolerances for mating features/elements without structural decoupling of the between the single unitary body and a barrel upon which the single unitary body is mounted. Such accommodation requires relatively larger dimensions and/or tolerancing of dimensions due to there being multiple interfaces for accommodating rotational positioning and/or axial positioning for the various feature/elements integral with the single unitary main body for providing both the gas routing functionality of the gas block and the gas block retaining functionality. For example, in U.S. Pat. No. 10,684,085, the gas block 180 includes a plurality of dimensional and tolerancing considerations for integral features/elements associated with integral gas routing and gas block retaining functionalities.

As best shown in FIGS. 4-9, the barrel 110 includes a gas block journal 112, a retention member recess 115, a bore 116, an alignment member recess 117, a gas port 118, and a gas block locating shoulder 119. The gas block journal 112 is located at an exterior surface of the barrel 110. The retention member recess 115 (FIGS. 4-6, 8, 9) extends through the gas block journal 112. The bore 116 (FIGS. 1-6) extends longitudinally along a length of the barrel 110 and typically includes rifling (not shown). Preferably, the gas block journal 112 is concentric with the bore 116 and the retention member recess 115 is perpendicular to the bore 116. The alignment member recess 117 (FIGS. 2, 3, 7) is within a surfaced of the gas block locating shoulder 119. The gas port 118 (FIGS. 6, 7) includes a first end 118A (FIG. 7) exposed at surface of the gas block journal 112 and a second end 118B (FIG. 6) expose within the bore 116.

The gas block 120 includes a rotational alignment member 126, a gas block central bore 132, a gas tube mounting body 136, and a gas port 140. The gas block central bore 132 (FIGS. 4-6, 10-13) has a diametrical size for operably mating with the gas block journal 112 of the barrel 110. A portion of an end face 120A of the gas block 120 defined by the retention member mounting body 130 may have the rotational alignment member 126 unitarily formed therewith and extending therefrom. The rotational alignment member 126 (FIGS. 2, 3, 10) is engageable with the alignment member recess 117 (FIGS. 2, 3, 7) for rotationally aligning the gas block 120 with the barrel 110 thereby enabling the end face 120A of the gas block 120 to contact the gas block locating shoulder 119.

The gas block central bore 132 and the gas block journal 112 are jointly configured to provide a dimensionally-clearanced interface therebetween. In accordance with the disclosures made herein, the dimensionally-clearance interface between the gas block central bore 132 and the gas block journal 112 beneficially enables manual engagement of the gas block 120 onto the gas block journal 112 and manual disengagement of the gas block 120 from the gas block journal 112. Such manual engagement and disengagement serves to allow the gas block 120 to be installed on and removed from the barrel 110 manually without the use of specialized devices and, preferably, using only a person's hands. To this end, the dimensionally-clearance interface between the gas block central bore 132 and the gas block journal 112 may, for example, be embodied as a clearance of less than a few thousands of an inch to as much as several thousands of an inch.

The gas block retaining assembly 121 includes the main body 122, a retention member 124, a retention member passage 125, a main body central bore 127, a travel limiting member 128, and a retention member mounting body 130. The retention member passage 125 intersects the main body central bore 127 to define an opening 134 (FIGS. 5, 12A, 12B, 13A, 13B) between the main body central bore 127 and the retention member passage 125.

The main body central bore 127 and the gas block journal 112 are jointly configured to provide a dimensionally-clearanced interface therebetween. In accordance with the disclosures made herein, the dimensionally-clearance interface between the main body central bore 127 and the gas block journal 112 beneficially enables manual engagement of the main body 122 onto the gas block journal 112 and manual disengagement of the main bod 122 from the gas block journal 112. Such manual engagement and disengagement serves to allow the as block retaining assembly 121 to be installed on and removed from the barrel 110 manually without the use of specialized devices and, preferably, using only a person's hands. To this end, the dimensionally-clearance interface between the main body central bore 127 and the gas block journal 112 may, for example, be embodied as a clearance of less than a few thousands of an inch to as much as several thousands of an inch.

Figure 4:
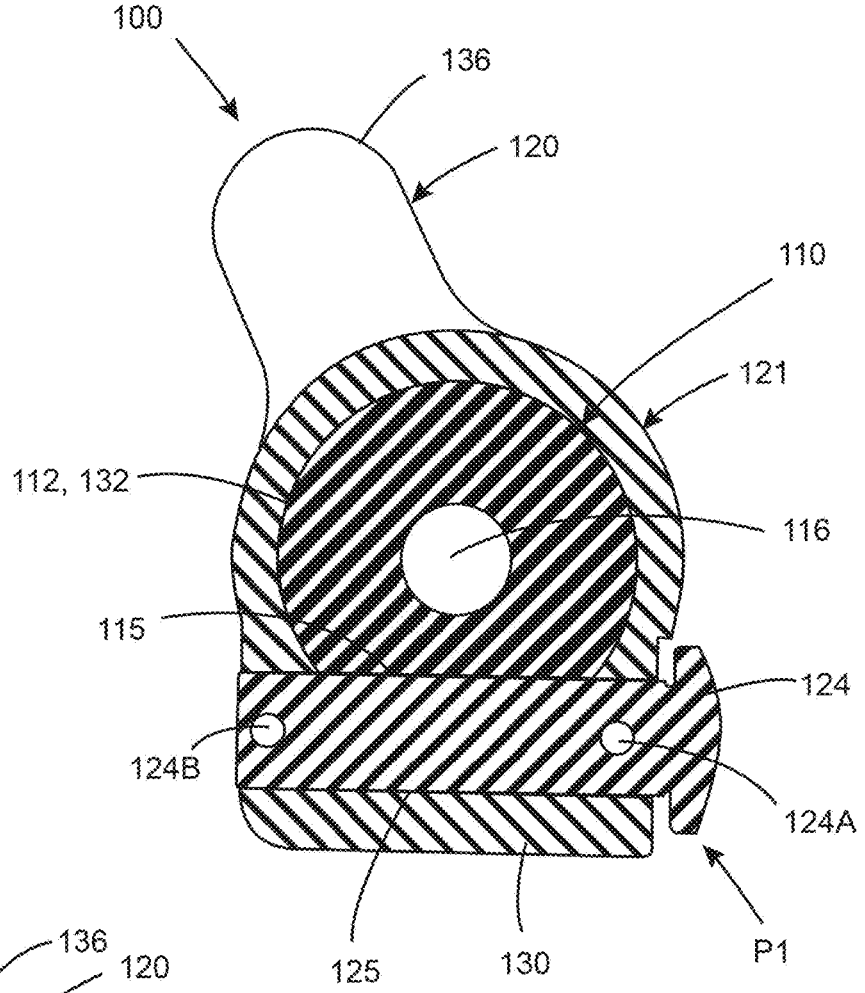
FIG. 4 is a cross-sectional view of the firearm barrel system taken along the line 4-4 in FIG. 3, where a retention member is in a first position.
Figure 5:
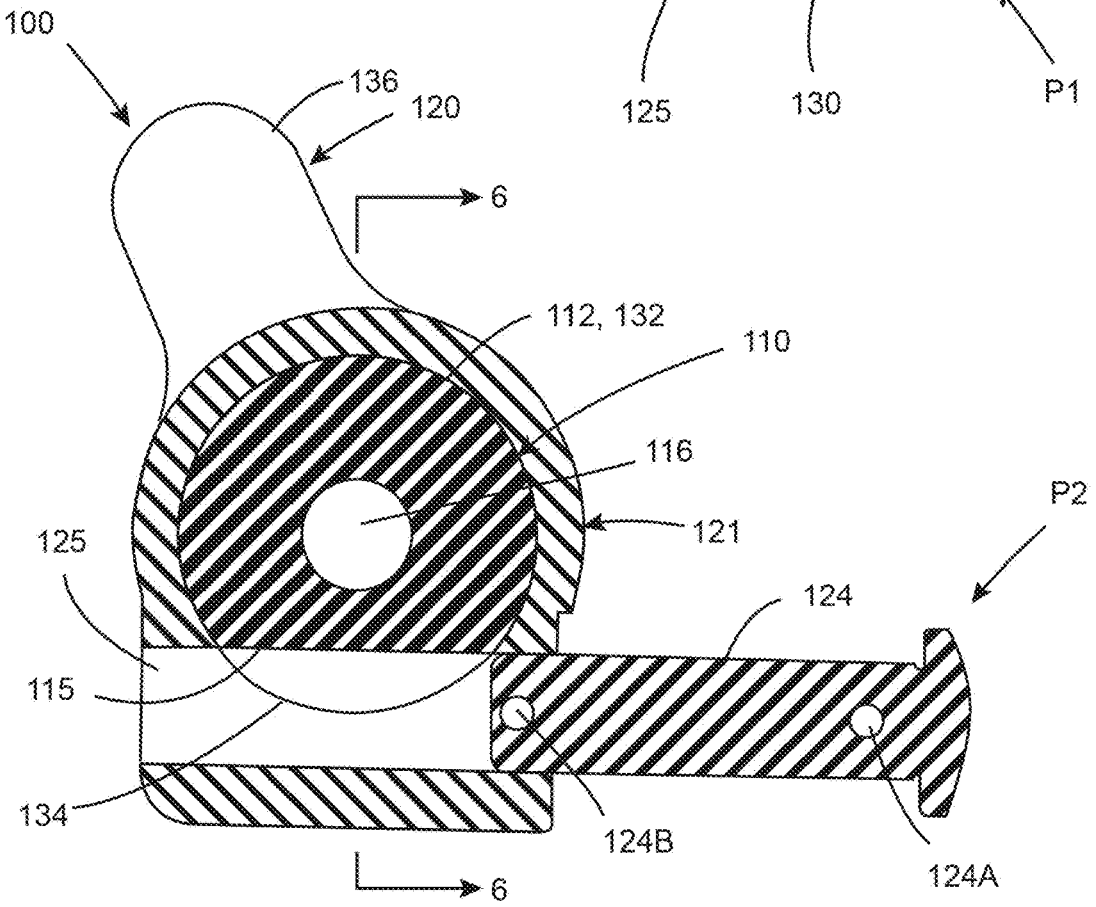
FIG. 5 is a cross-sectional view of the firearm barrel system, where the retention member is in a second position

The retention member 124 (FIGS. 1-5, 12,A, 12B) is movable engaged within the retention member passage 125 for being moved between a first position P1 (FIG. 1-4) and a second position P2 (FIG. 5). In preferred embodiments, the retention member 124 is slidable axially between the first position P1 and the second position P2 and the retention member passage 125 extends perpendicularly to the main body central bore 127. The retention member 124 and the retention member passage 125 are jointly configured to provide a dimensionally-clearanced interface therebetween. In accordance with the disclosures made herein, the dimensionally-clearanced interface between the retention member 124 and the retention member passage 125 enables manual engagement of the retention member 124 into the retention member passage 125 and selective manual movement of the retention member 124 relative to the gas block 120 between the first and second position P1, P2. Such manual engagement of the retention member 124 into the retention member passage 125 and selective manual movement of the retention member 124 relative to the gas block 120 between the first and second position P1, P2 serves to allow the retention member 124 to be installed on and moved relative to the gas block 120 manually without the use of specialized devices and, preferably, using only hands of a person. To this end, the dimensionally-clearance interface between the retention member 124 and the retention member passage 125 may, for example, be embodied as a clearance of less than a few thousands of an inch to as much as several thousands of an inch.

Mounting the gas block system on the barrel 110 starts with engaging the gas block 120 on the gas block journal 112 (i.e., rotationally aligned with the gas port 118 of the barrel 110 and abutting the gas block locating shoulder 119). Next, the gas block retaining assembly 121 is engaged with the gas block journal 112, such that a front end face of the gas block 120 is engaged a rear face of the main body 122 and with the main body gas block 120 rotated for enabling the retention member 124 to be moved from the second position P2 to the first position P1 whereby a barrel-engaging portion of the retention member 124 extends through the opening 134 into the main body central bore 127 and into engagement with the retention member recess 115 of the barrel 110 (FIG. 4). Such engagement of the retention member 124 with the retention member recess 115 fixedly secures the gas block retaining assembly 121 and, thus, the gas block 120 onto the barrel 110 in respective fixed positions whereby unrestricted axial and rotational movement between the gas block 120, the gas block retaining assembly 121, and the barrel 110 is inhibited or otherwise rendered operably negligible. Moving the retention member 124 from the first position P1 to the second position P2 results in no portion of the retention member 124 extending through the opening 134 into engagement with the retention member recess 115, thereby enabling the gas block retaining assembly 121 and, thus, the gas block 120 to be disengaged from the gas block journal 112 and removed from the barrel 110 (FIG. 5).

In some embodiments, the main body 122 and the gas block journal 112 (or other portion of the barrel 110) may include mating indexing features (e.g., a protrusion in one body that engages a slot in the other body) for enabling gross (i.e., overall or general) alignment of the main body 122 with the retention member recess 115. Such mating indexing features may provide for generally aligning the gas block retaining assembly 121 with the barrel to rapidly enable the main body 122 to be brought into abutted engagement with the gas block 120 where the retention member 124 is fully or nearly aligned with the retention member recess 115. In some embodiments, the gas block 120 and the main body 122 may be coupled to each other to inhibit axial separation therebetween (e.g., while permitting limited axial movement therebetween) while permitting unrestricted or partially limited rotational movement therebetween.

Figure 14:
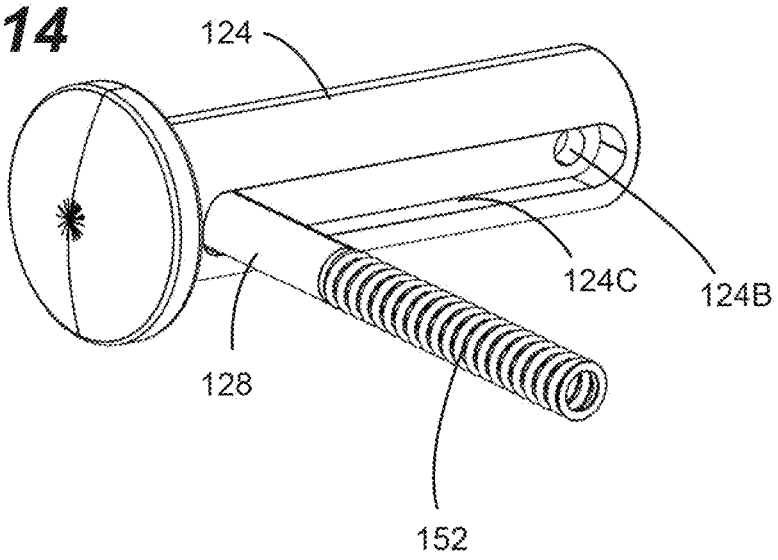
FIG. 14 is a perspective view of an as-mounted arrangement of a retention member, travel limiting member, and compression spring of the gas block retaining assembly shown in FIGS. 1-5, with a main body of the gas block retaining assembly omitted.
Figure 15:
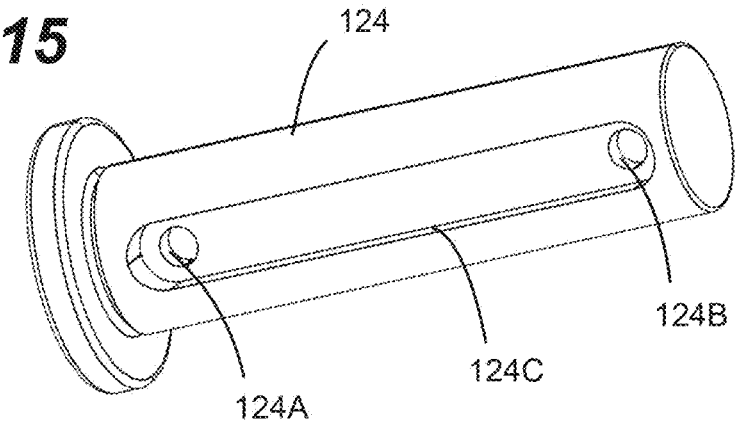
FIG. 15 is a perspective of the retention member shown in FIG. 14.
Figure 16:
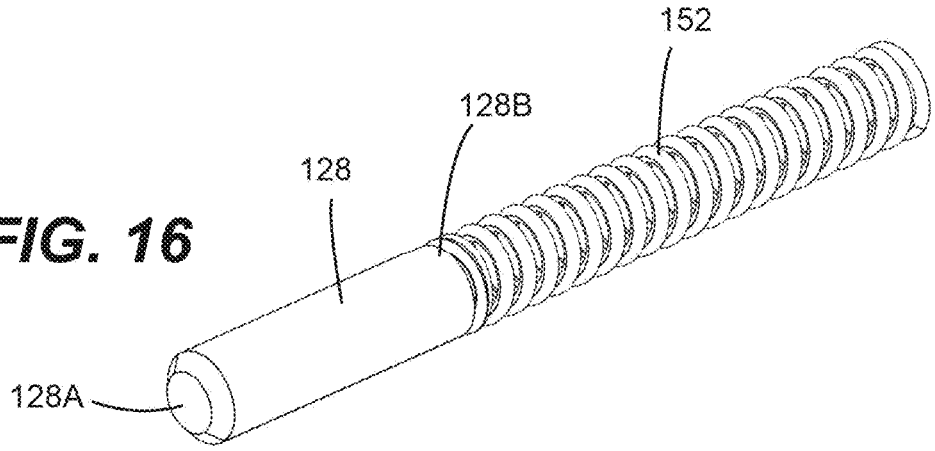
FIG. 16 is a perspective view of the travel limiting member and the compression spring shown in FIG. 14.

Referring now to FIGS. 4, 5, 12A, 12B, and 14-16, the travel limiting member 128 is slidably engaged within a mating passage 150 of the gas block 120. The travel limiting member 128 (FIGS. 12B, 14, 16) is forcibly biased into engagement with the retention member 124 such as via engagement at a rear end portion 128B of the travel limiting member 128 by a compression spring 152 (FIGS. 14, 16). A tip portion 128A of the travel limiting member 128 (FIGS. 12B, 16) is engageable with one or more mating features of the retention member 124 for limiting movement of the retention member 124 to being between the first and second positions P1, P2, for selectively retaining the retaining member 124 at the first and second positions P1, P2, and/or for limiting unrestricted rotational movement of the retention member 124 about a longitudinal centerline axis thereof. Position control recesses 124A, 124B (FIGS. 4, 5, 14, 15) are examples of mating features of the retention member 124 for limiting movement of the retention member to be between the first and second positions P1, P2 and/or for retaining the retaining member 124 at the first and second positions P1, P2. Anti-rotation groove 124C (FIGS. 14, 15) is an example of a mating feature of the retention member 124 for limiting movement of the retention member to be between the first and second positions P1, P2 and for limiting unrestricted rotational movement of the retention member 124 about the longitudinal centerline axis thereof. To these ends, the tip portion 128A (FIGS. 12B, 16) of the travel limiting member 128 may engage a first one of the position control recesses 124A when the retention member 124 is in the first position P1, may engage a second one of the position control recesses 124B when the retention member 124 is in the second position P2, and may be engaged within the anti-rotation groove 124C during movement between the first and second positions P1, P2.

Referring now to FIGS. 1-6 and 10-11, the gas block 120 includes a gas tube mounting body 136 and the gas tube mounting body 136 includes a gas tube receiving cavity 138. A gas routing passage 140 (FIGS. 10, 11) of the gas block 120 has a first end 140A (FIG. 11) exposed within the gas block central passage 132 and a second end 140B (FIG. 10) exposed within the gas tube receiving cavity 138. With the gas block 120 fixedly secured onto the barrel 110 via engagement of the retention member 124 with the retention member recess 115, the first end 140A of the gas routing passage 140 is at least partially aligned (and preferably fully or majority aligned) with the first end 118A of the gas port 118 (FIG. 6) for enabling flow of combustion gas from the bore 116 of the barrel 110 into the gas tube receiving cavity 138 of the gas tube mounting body 136.

To limit leakage of combustion gas at the interface between the gas block central bore 132 and the gas block journal 112, the gas block 120 may include a plurality of gas flow control discontinuities 142 (FIGS. 6, 10, 11) integral with the surface of the gas block 120 that defines the gas block central passage 132. Placement and configuration of the gas flow control discontinuities 142 create an increased volumetric space into which the combustion gas that may leak from the interface between the gas port 140 and the gas routing passage 118 may expand. In effect, this gas expansion and associated gas flow perturbance (e.g., expansion-generated turbulence) generate a leakage control zone that reduces the potential for and/or magnitude of escaped combustion gas that may flow through the interface between the gas block central bore 132 and the gas block journal 112.

Figure 6:
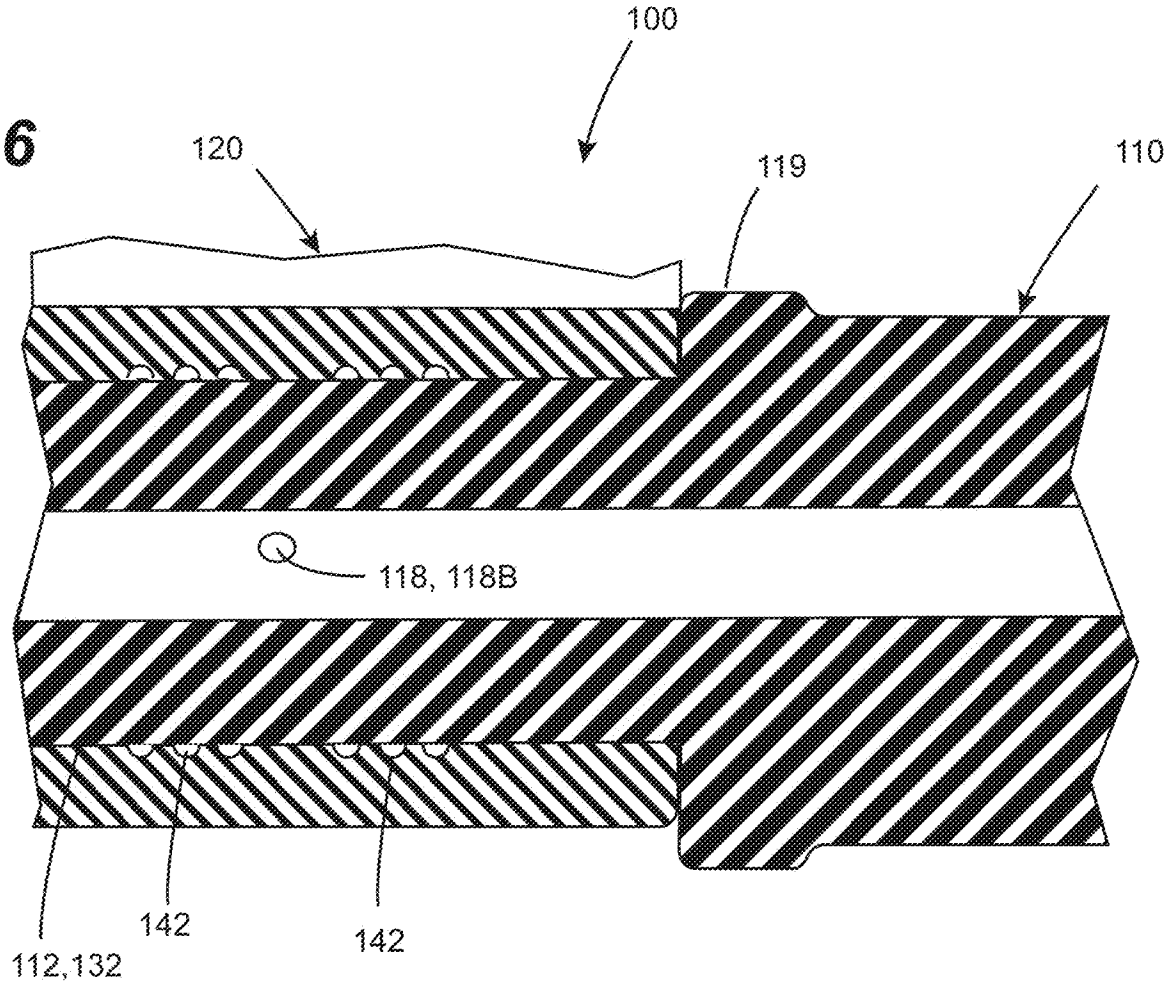
FIG. 6 is a cross-sectional view taken along the line 6-6 in FIG. 5, where the retention member is in the second position.
Figure 7:
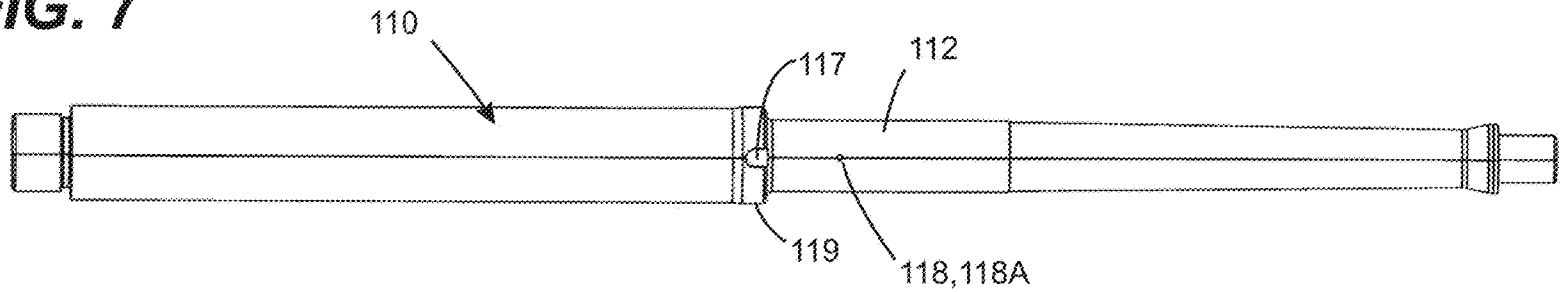
FIG. 7 is a first side view of a barrel of the firearm receiver system shown in FIGS. 1-6 (threads at opposing end portions omitted).
Figure 8:
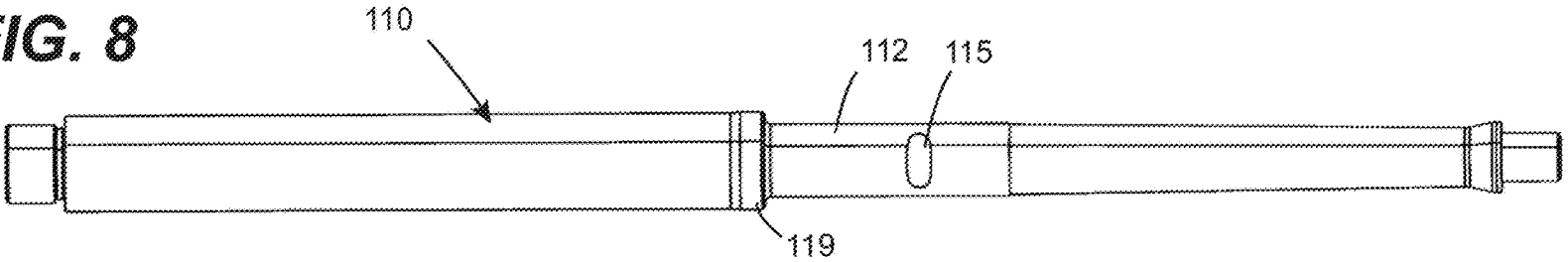
FIG. 8 is second side view of the barrel shown in FIG. 7
Figure 9:
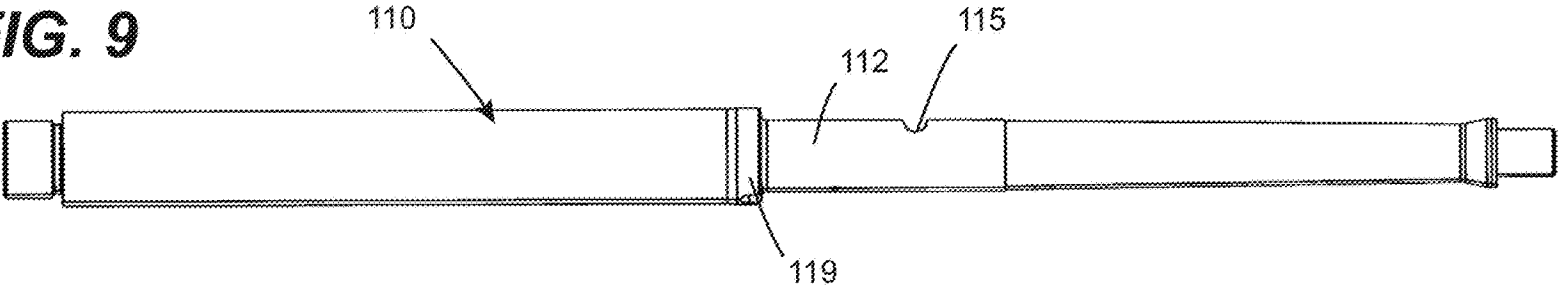
FIG. 9 is third side view of the barrel shown in FIG. 7
Figure 10:
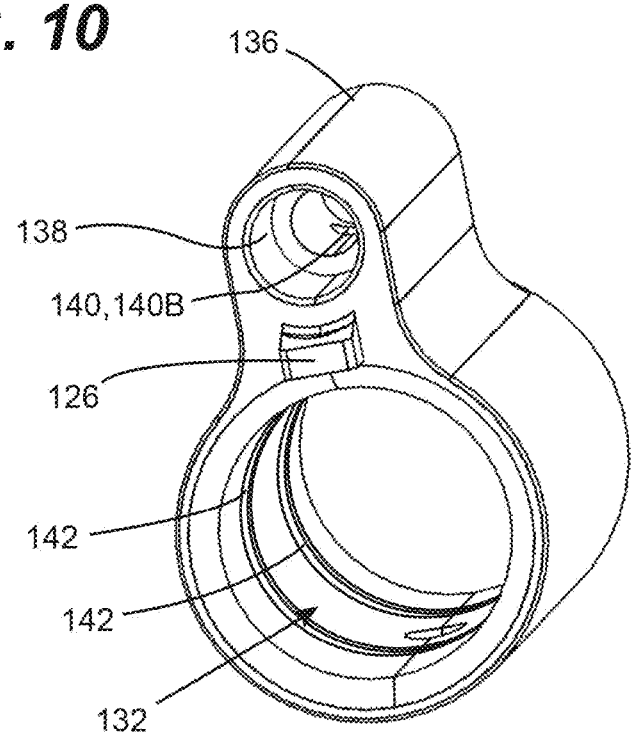
FIG. 10 is a first perspective view of a gas block of the firearm receiver system shown in FIGS. 1-6.
Figure 11:
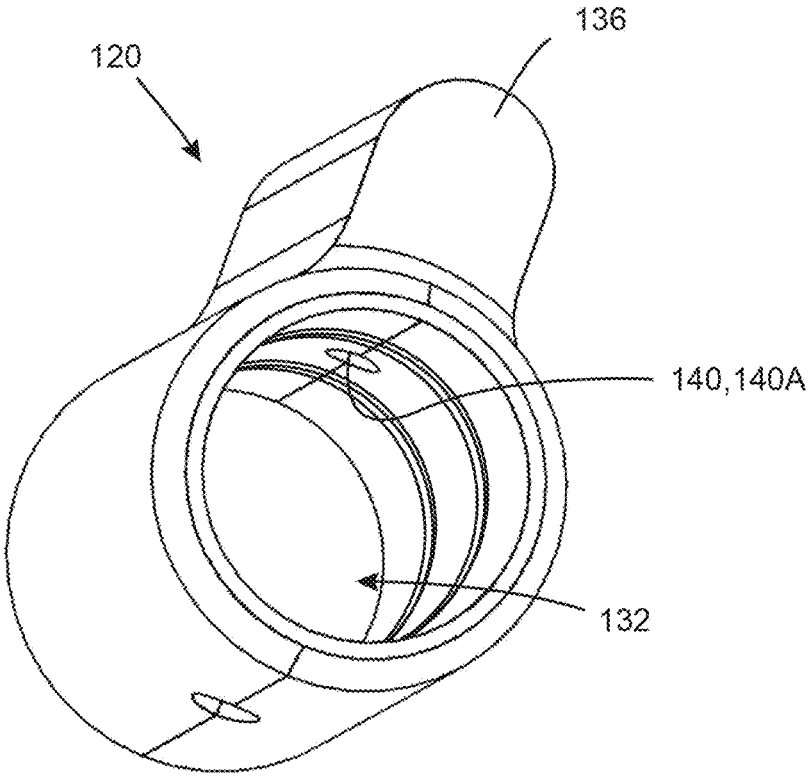
FIG. 11 is a second perspective view of the gas block shown in FIG. 10.
Figure 12A:
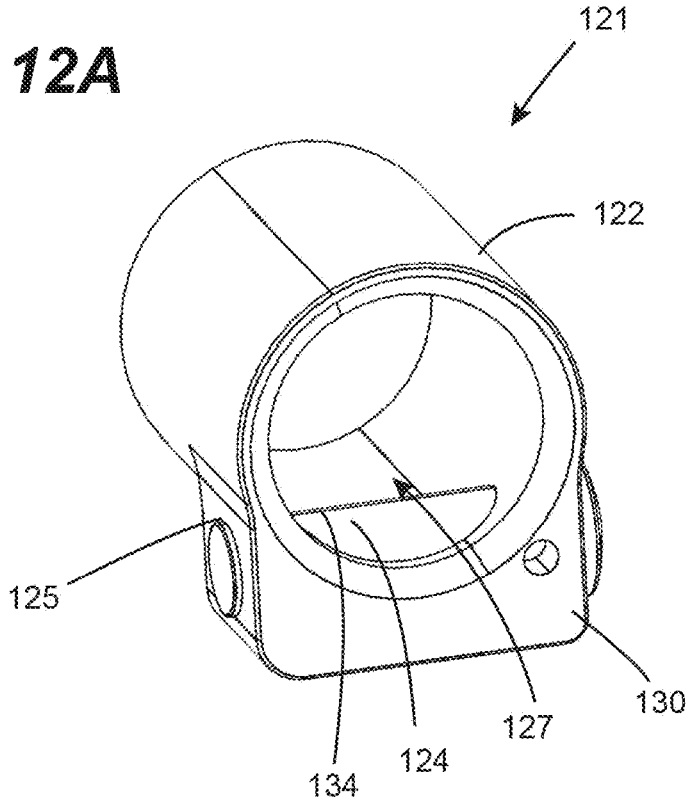
FIG. 12A is a first perspective view of a gas block retaining assembly shown in FIGS. 1-5.
Figure 12B:
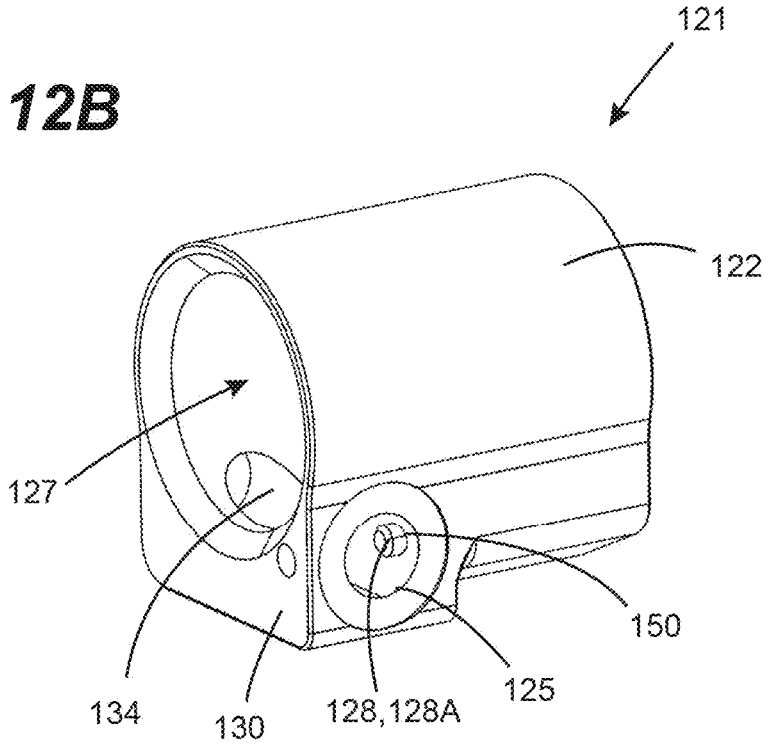
FIG. 12B is a second perspective view of the gas block retaining assembly shown in FIGS. 1-5, with a retention member thereof omitted.
Figure 13A:
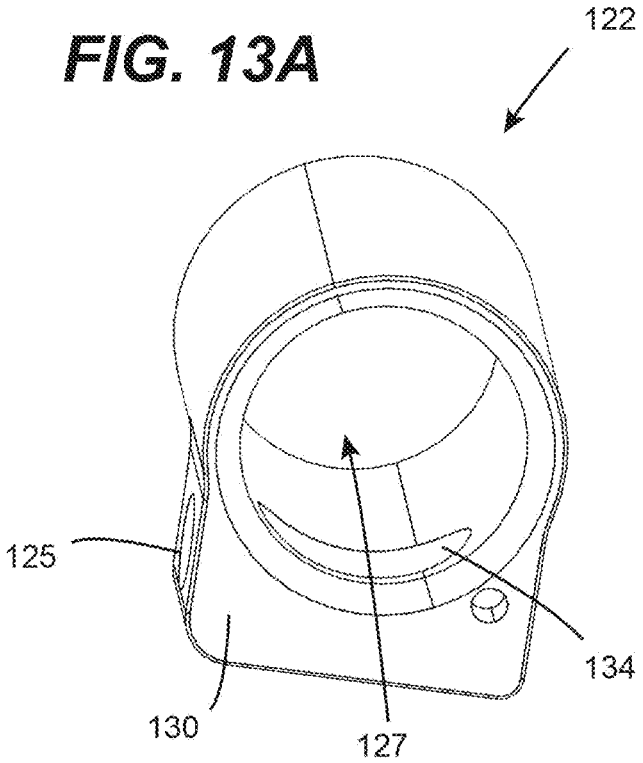
FIG. 13A is a first perspective view of a main body of the gas block retaining assembly shown in FIGS. 1-5.
Figure 13B:
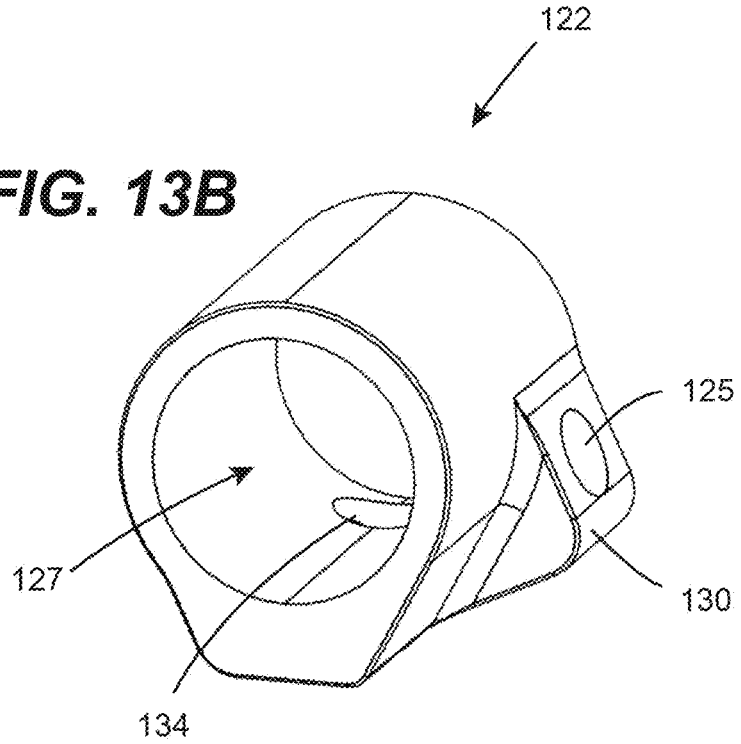
FIG. 13B is a second perspective view of the main body of the gas block retaining assembly shown in FIGS. 1-5.
Figure 17:
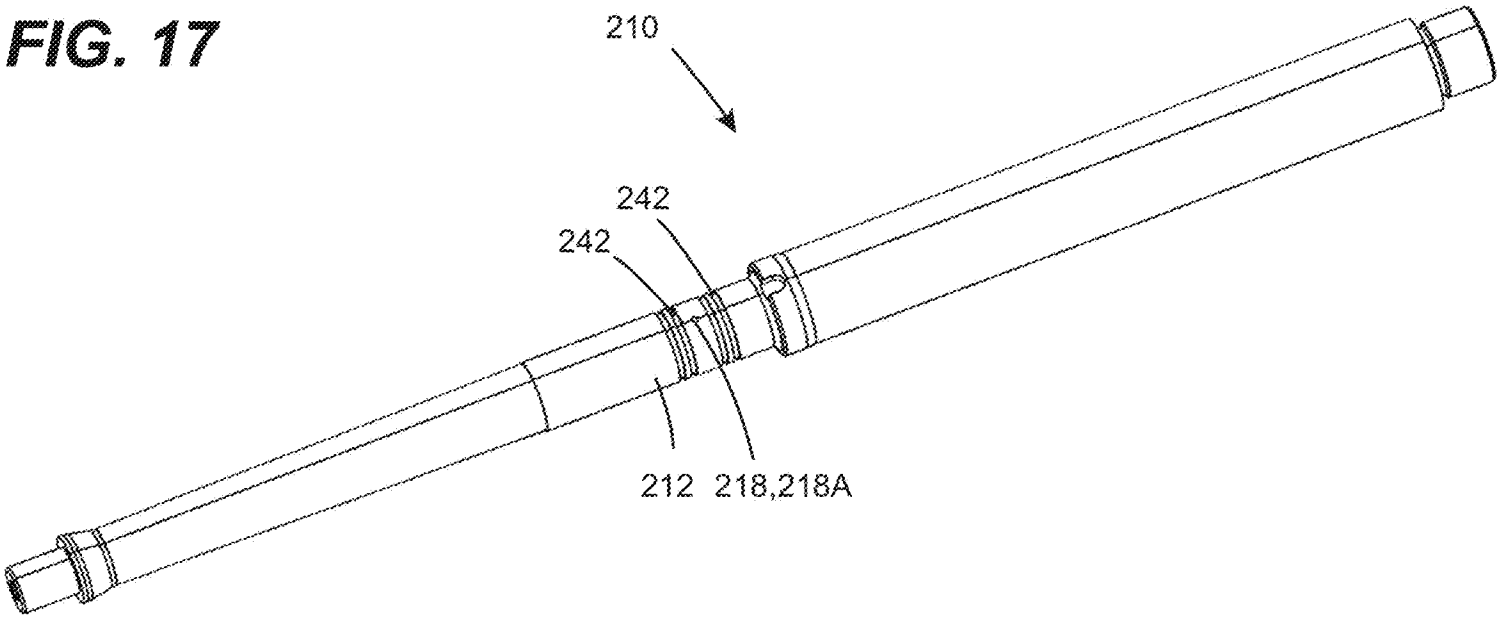
FIG. 17 is a perspective view of a barrel of a firearm receiver system in accordance with a second embodiment of the disclosures made herein.

The leakage control zone may be implemented as two or more spaced-apart discontinuities having the first end 140A of the gas routing passage 140 positioned therebetween (FIGS. 6, 10, 11). The discontinuities may be in the form of two spaced-apart discontinuities or two spaced-apart groups of discontinuities. In some embodiments, the discontinuities are grooves each fully and/or partially encircling the gas block central passage 132, rows of discrete spaced-apart recesses (e.g., dimples) each fully or partially encircling the gas block central passage 132, or other types of contiguously-extending or discrete structures that serve to generate gas flow perturbance in the leakage control zone via an abrupt change in volume and clearance within the interface between the gas block central bore 132 and the gas block journal 112. As shown in FIG. 17, a leakage control zone in accordance with embodiments of the disclosures made herein may be implemented via two or more spaced-apart discontinuities 242 on the gas block journal 212 having a first end 218A of a gas port 218 within the barrel 210 positioned therebetween.

Figure 18A:
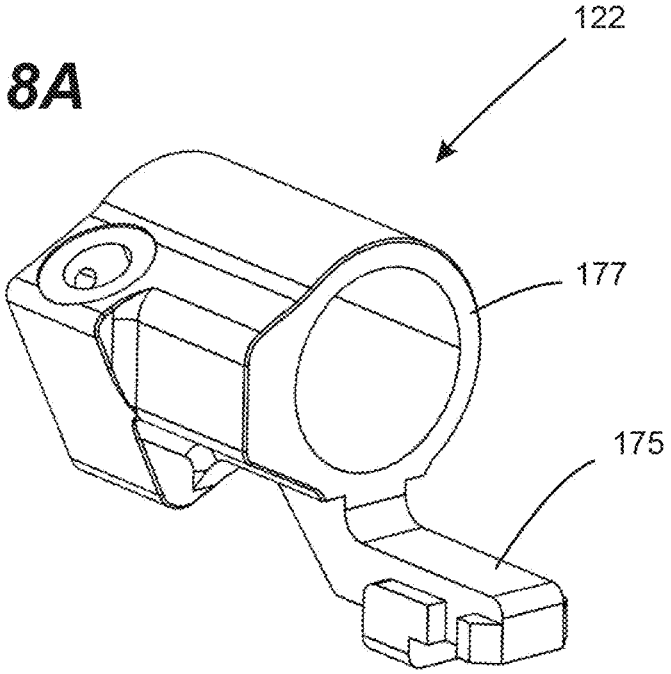
FIG. 18A is a first perspective view of a main body of a gas block retaining assembly in accordance with a second embodiment of the disclosures made herein.
Figure 18B:
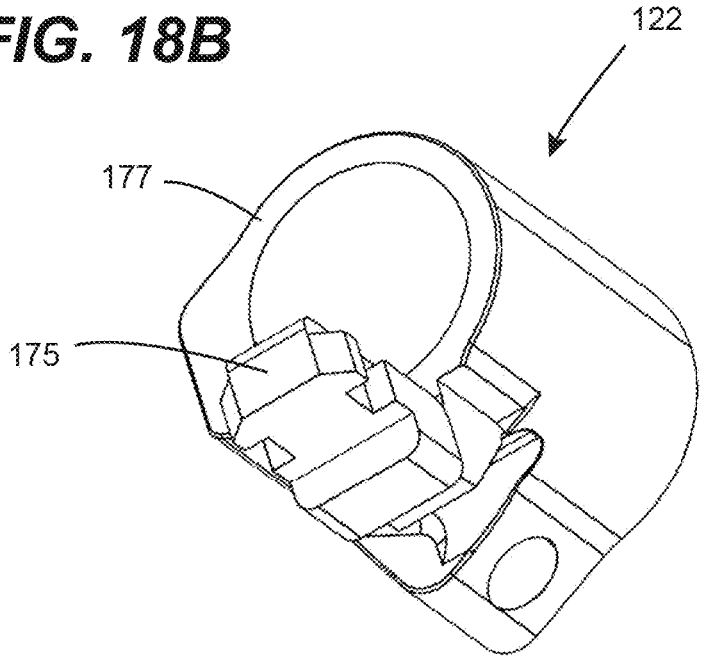
FIG. 18B is a second perspective view of the main body shown in FIG. 18A.

Referring now to FIGS. 18A and 18B, in some embodiments of the disclosures made herein, the main body 122 of the gas block retaining assembly 121 may include an accessory mounting structure 175 extend beyond a front end face 177 of the main body 122. A bayonet-style mounting structure is one example of the accessory mounting structure 175. Advantageously, when a firearm is equipped with a gas block system including a gas block retaining assembly 121 having a main body comprising the accessory mounting structure 175, an accessory with a mating accessory mounting structure may be attached to the accessory mounting structure 175. Advantageously, gas block systems in accordance with embodiment of the disclosures made herein enable a user or manufacturer or other person/entity to switch from a main body without an accessory mounting structure to a main body with an accessory mounting structure or vice-versa, as desired or needed.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm gas block system, comprising:

a gas block having a central bore extending through opposing end faces of the gas block, wherein a first one of the opposing end faces of the gas block is a main body engagement face and wherein the central bore of the gas block has a diametrical size for operably mating with a gas block journal of a barrel; and a gas block retaining assembly including a main body having a central bore extending through opposing end faces of the main body, a retention member passage intersecting the central bore of the main body to define an opening between the central bore of the main body and the retention member passage, and a retention member within the retention member passage, wherein the retention member is moveable between a first position within which at least a portion of the retention member extends through the opening into the central bore of the main body and a second position within which no portion of the retention member extends through the opening into the central bore of the main body, wherein a second one of the opposing end faces of the main body is a gas block engagement face, and wherein the central bore of the main body has a diametrical size for operably mating with the gas block journal of the barrel.

2. The firearm gas block system of claim 1, wherein:

the gas block includes a gas tube mounting body;

the main body includes a retention member mounting body; and the retention member passage is within the retention member mounting body.

3. The firearm gas block system of claim 1, wherein:

the main body includes a retention member mounting body; and the retention member passage is within the retention member mounting body.

4. The firearm gas block system of claim 2, wherein:

the gas block includes a rotational alignment member; and the rotational alignment member is a unitarily-formed part of the gas block.

5. The firearm gas block system of claim 4, wherein rotational alignment member extends beyond a second one of the opposing end faces of the gas block.

6. The firearm gas block system of claim 1, wherein the gas block and the main body are discrete bodies.

7. The firearm gas block system of claim 6, wherein the main body engagement face and the gas block engagement face are jointly configured to provide flush engagement when the respective central bore thereof is operably mated with the gas block journal of the barrel.

8. The firearm gas block system of claim 1, wherein:

the gas block includes a plurality of gas flow control discontinuities;

the plurality of gas flow control discontinuities includes two spaced-apart groves each within the gas block extending circumferentially around the central bore of the gas block;

the gas block includes a gas tube mounting body having a gas tube receiving cavity and a gas routing passage having a first end exposed within the central bore of the gas block and a second end exposed within the gas tube receiving cavity; and the first end of the gas routing passage is exposed within the central bore of the gas block between the two spaced-apart groves.

9. The firearm gas block system of claim 1, wherein:

the gas block retaining assembly includes a travel limiting member;

the travel limiting member is in spring-biased engagement with the retention member; and a tip portion of the travel limiting member is engageable with one or more mating features of the retention member for limiting movement of the retention member to be between the first and second positions.

10. The firearm gas block system of claim 9, wherein the one or more mating features of the retention member includes a groove.

11. The firearm gas block system of claim 9, wherein:

the one or more mating features of the retention member includes spaced-apart position control recesses that each define a respective one of the first position of the retention member and the second position of the retention member; and the tip portion of the travel limiting member engages a first one of the position control recesses when the retention member is in the first position and engages a second one of the position control recesses when the retention member is in the second position.

12. The firearm gas block system of claim 11, wherein:

the one or more mating features of the retention member includes a groove having opposing ends; and the first one of the position control recesses is located at or adjacent a first one of the opposing ends of the groove and the second one of the position control recesses is located at or adjacent a second one of the opposing ends of the groove.

13. The firearm gas block system of claim 11, wherein the gas block and the main body are discrete bodies.

14. The firearm gas block system of claim 9, wherein the gas block and the main body are discrete bodies.

15. The firearm gas block system of claim 14, wherein the main body engagement face and the gas block engagement face are jointly configured to provide flush engagement when the respective central bore thereof is operably mated with the gas block journal of the barrel.

16. The firearm gas block system of claim 15, wherein:

the gas block includes the plurality of gas flow control discontinuities;

the plurality of gas flow control discontinuities includes two spaced-apart groves each within the gas block extending circumferentially around the central bore of the gas block;

the gas block includes a gas tube mounting body having a gas tube receiving cavity and a gas routing passage having a first end exposed within the central bore of the gas block and a second end portion within the gas tube receiving cavity; and the first end of the gas routing passage is exposed within the central bore of the gas block between the two spaced-apart groves.

17. A firearm gas block system, comprising:

a gas block engageable with a gas block journal of a barrel, wherein the gas block includes barrel engagement surfaces for engaging mating engagement surfaces of the barrel to locate the gas block in a prescribed axial position and a prescribed rotational position relative to an outlet of a gas port exposed a surface of the gas block journal, wherein the gas block includes a gas passage for routing combustion gas from the gas port to a gas tube receiving cavity of the gas block when the gas block is engaged with the gas block journal in the prescribed axial position and the prescribed rotational position; and a gas block retaining assembly including a main body engageable with the gas block journal in a rotational position independent of the prescribed rotational position of the gas block, wherein the gas block retaining assembly includes a retention member engaged with the main body and engageable with a recess in the barrel for securing the main body in a prescribed axial position and a prescribed rotational position relative to the gas port.

18. The firearm gas block system of claim 17, wherein:

the retention member is within a retention member passage of the main body;

the main body includes a central bore extending through opposing end faces thereof;

the retention member passage intersects the central bore of the main body to define an opening between the central bore of the main body and the retention member passage; and the retention member is moveable between a first position within which at least a portion of the retention member extends through the opening into the central bore of the main body and a second position within which no portion of the retention member extends through the opening into the central bore of the main body.

19. The firearm gas block system of claim 17, wherein:

the gas block includes a main body engagement face at an end portion thereof;

the main body includes a gas block engagement face at an end portion thereof; and the main body engagement face and the gas block engagement face are jointly configured to provide flush engagement when the gas block and the main body are both mounted on the gas block journal of the barrel.

20. The firearm gas block system of claim 17, wherein:

the gas block includes a plurality of gas flow control discontinuities and a gas tube mounting body the gas tube mounting body includes a gas tube receiving cavity and a gas routing passage having a first end exposed within the central bore of the gas block and a second end exposed within the gas tube receiving cavity;

the plurality of gas flow control discontinuities includes two spaced-apart groves each within the gas block extending circumferentially around a central bore of the gas block; and the first end of the gas routing passage is exposed within the central bore of the gas block between the two spaced-apart groves.

21. The firearm gas block system of claim 20, wherein:

the retention member is within a retention member passage of the main body;

the main body includes a central bore extending through opposing end faces thereof;

the retention member passage intersects the central bore of the main body to define an opening between the central bore of the main body and the retention member passage; and the retention member is moveable between a first position within which at least a portion of the retention member extends through the opening into the central bore of the main body and a second position within which no portion of the retention member extends through the opening into the central bore of the main body.

22. The firearm gas block system of claim 21, wherein:

the gas block includes a main body engagement face at an end portion thereof;

the main body includes a gas block engagement face at an end portion thereof; and the main body engagement face and the gas block engagement face are jointly configured to provide flush engagement when the gas block and the main body are both mounted on the gas block journal of the barrel.

23. The firearm gas block system of claim 20, wherein:

the gas block includes a main body engagement face at an end portion thereof;

the main body includes a gas block engagement face at an end portion thereof; and the main body engagement face and the gas block engagement face are jointly configured to provide flush engagement when the gas block and the main body are both mounted on the gas block journal of the barrel.

24. The firearm gas block system of claim 17, wherein the gas block and the main body are discrete bodies.

25. A firearm, comprising:

a barrel including a gas block journal at an exterior surface thereof, a retention member recess extending through the gas block journal, a bore extending longitudinally along a length of the barrel, and a gas port having an outlet thereof exposed at the gas block journal and a second end expose within the bore;

a gas block engageable with the gas block journal, wherein the gas block includes barrel engagement surfaces engaged with mating engagement surfaces of the barrel for locating the gas block in a prescribed axial position and a prescribed rotational position relative to the outlet of the gas port, wherein the gas block includes a gas passage for routing combustion gas from the gas port to a gas tube receiving cavity of the gas block when the gas block is engaged with the gas block journal in the prescribed axial position and the prescribed rotational position; and a gas block retaining assembly including a main body engageable with the gas block journal in a rotational position independent of the prescribed rotational position of the gas block, wherein the gas block retaining assembly includes a retention member engaged with the main body and engageable with the retention member recess for securing the main body in a prescribed axial position and a prescribed rotational position relative to the gas port.

26. The firearm of claim 25, wherein the gas block and the main body are discrete bodies.

27. The firearm of claim 25, wherein:

the retention member is within a retention member passage of the main body;

the main body includes a central bore extending through opposing end faces thereof;

the retention member passage intersects the central bore of the main body to define an opening between the central bore of the main body and the retention member passage; and the retention member is moveable between a first position within which at least a portion of the retention member extends through the opening into the central bore of the main body and a second position within which no portion of the retention member extends through the opening into the central bore of the main body.

28. The firearm of claim 25, wherein:

the gas block includes a main body engagement face at an end portion thereof;

the main body includes a gas block engagement face at an end portion thereof; and the main body engagement face and the gas block engagement face are jointly configured to provide flush engagement when the gas block and the main body are both mounted on the gas block journal of the barrel.

29. The firearm of claim 25, wherein:

the gas block includes a plurality of gas flow control discontinuities and a gas tube mounting body the gas tube mounting body includes a gas tube receiving cavity and a gas routing passage having a first end exposed within the central bore of the gas block and a second end exposed within the gas tube receiving cavity;

the plurality of gas flow control discontinuities includes two spaced-apart groves each within the gas block extending circumferentially around a central bore of the gas block; and the first end of the gas routing passage is exposed within the central bore of the gas block between the two spaced-apart groves.

30. The firearm of claim 29, wherein:

the retention member is within a retention member passage of the main body;

the main body includes a central bore extending through opposing end faces thereof;

the retention member passage intersects the central bore of the main body to define an opening between the central bore of the main body and the retention member passage;

the retention member is moveable between a first position within which at least a portion of the retention member extends through the opening into the central bore of the main body and a second position within which no portion of the retention member extends through the opening into the central bore of the main body;

the gas block includes a main body engagement face at an end portion thereof;

the main body includes a gas block engagement face at an end portion thereof;

the main body engagement face and the gas block engagement face are jointly configured to provide flush engagement when the gas block and the main body are both mounted on the gas block journal of the barrel; and the gas block and the main body are discrete bodies.

* * * * *